US009548592B2

(12) United States Patent
Fujino et al.

(10) Patent No.: US 9,548,592 B2
(45) Date of Patent: Jan. 17, 2017

(54) SPARK PLUG

(71) Applicant: NGK Spark Plug Co., LTD., Nagoya (JP)

(72) Inventors: Tadatoshi Fujino, Konan (JP); Kenji Ban, Gifu (JP); Yuichi Yamada, Niwa (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 103 days.

(21) Appl. No.: 14/582,801

(22) Filed: Dec. 24, 2014

(65) Prior Publication Data

US 2015/0180215 A1 Jun. 25, 2015

(30) Foreign Application Priority Data

Dec. 24, 2013 (JP) ..... 2013-265208

(51) Int. Cl.
*H01T 13/39* (2006.01)
*H01T 13/16* (2006.01)
*H01T 13/20* (2006.01)

(52) U.S. Cl.
CPC ..... *H01T 13/39* (2013.01); *H01T 13/16* (2013.01); *H01T 13/20* (2013.01)

(58) Field of Classification Search
None
See application file for complete search history.

(56) References Cited

U.S. PATENT DOCUMENTS

| | | | |
|---|---|---|---|
| 5,144,188 | A | 9/1992 | Kagawa et al. |
| 6,653,768 | B2 | 11/2003 | Kato et al. |
| 7,528,534 | B2 | 5/2009 | Kuki et al. |
| 2010/0314987 | A1 | 12/2010 | Kyuno et al. |
| 2012/0161605 | A1 | 6/2012 | Ban et al. |

(Continued)

FOREIGN PATENT DOCUMENTS

| | | | |
|---|---|---|---|
| EP | 0453277 | A | 10/1991 |
| EP | 2216862 | A | 8/2010 |

(Continued)

OTHER PUBLICATIONS

European Search Report mailed May 27, 2015 for the corresponding European Application No. 14200288.0.

(Continued)

*Primary Examiner* — Ashok Patel
(74) *Attorney, Agent, or Firm* — Leason Ellis LLP

(57) ABSTRACT

A sparkplug includes: an insulator with an axial hole extending along an axial line; a metal shell covering the insulator; and a shelf part inside the metal shell. The insulator includes a second column part formed in the front end side of a tapering part. When a volume surrounded by a first plane that passes through the front end of the shelf part of the metal shell and is orthogonal to the axial line, a curved surface extending from an outer circumference of the second column part, and an outer circumferential surface of the insulator is defined as A, and a volume surrounded by the first plane, the curved surface, a second plane that passes through the front end of the metal shell and is orthogonal to the axial line, and the axial hole of the insulator is defined as B, a relational expression $0.9 \leq A/B \leq 2.4$ is satisfied.

14 Claims, 10 Drawing Sheets

(56) References Cited

U.S. PATENT DOCUMENTS

2014/0097739 A1* 4/2014 Sumoyama ..... H01T 13/20
313/141

FOREIGN PATENT DOCUMENTS

| | | | |
|---|---|---|---|
| JP | 2001-237045 | A | 8/2001 |
| JP | 2002-260817 | A | 9/2002 |
| JP | 2006-183177 | A | 7/2005 |
| JP | 2011-544418 | A | 3/2011 |

OTHER PUBLICATIONS

Office Action mailed Oct. 27, 2015 for the corresponding Japanese Application No. 2013-265208.

* cited by examiner

FIG. 7

| SAMPLE NO. | A ($mm^3$) | B ($mm^3$) | A/B | PRE-IGNITION ADVANCE TIMING (°BTDC) | ANTI PRE-IGNITION PERFORMANCE |
|---|---|---|---|---|---|
| A01 | 61 | 28 | 2.2 | 48 | S |
| A02 | 65 | 30 | 2.2 | 48 | S |
| A03 | 60 | 29 | 2.1 | 48 | S |
| A04 | 57 | 27 | 2.1 | 48 | S |
| A05 | 57 | 28 | 2.0 | 48 | S |
| A06 | 61 | 30 | 2.0 | 48 | S |
| A07 | 58 | 31 | 1.9 | 48 | S |
| A08 | 62 | 33 | 1.9 | 48 | S |
| A09 | 61 | 34 | 1.8 | 47 | A |
| A10 | 57 | 31 | 1.8 | 47 | A |
| A11 | 57 | 33 | 1.7 | 47 | A |
| A12 | 61 | 36 | 1.7 | 47 | A |
| A13 | 62 | 38 | 1.6 | 47 | A |
| A14 | 64 | 40 | 1.6 | 47 | A |
| A15 | 59 | 39 | 1.5 | 47 | A |
| A16 | 63 | 42 | 1.5 | 47 | A |
| A17 | 57 | 40 | 1.4 | 47 | A |
| A18 | 61 | 43 | 1.4 | 47 | A |
| A19 | 52 | 41 | 1.3 | 46 | B |
| A20 | 56 | 43 | 1.3 | 46 | B |
| A21 | 53 | 42 | 1.3 | 46 | B |
| A22 | 53 | 44 | 1.2 | 46 | B |
| A23 | 56 | 47 | 1.2 | 46 | B |
| A24 | 50 | 43 | 1.2 | 46 | B |
| A25 | 53 | 48 | 1.1 | 46 | B |
| A26 | 50 | 47 | 1.1 | 46 | B |
| A27 | 54 | 50 | 1.1 | 46 | B |
| A28 | 54 | 53 | 1.0 | 46 | B |
| A29 | 51 | 50 | 1.0 | 46 | B |
| A30 | 53 | 51 | 1.0 | 46 | B |
| A31 | 51 | 54 | 0.9 | 46 | B |
| A32 | 53 | 56 | 0.9 | 46 | B |
| A33 | 48 | 52 | 0.9 | 46 | B |
| A34 | 48 | 59 | 0.8 | 45 | C |
| A35 | 45 | 56 | 0.8 | 45 | C |
| A36 | 50 | 60 | 0.8 | 45 | C |

FIG. 8

| SAMPLE NO. | A ($mm^3$) | B ($mm^3$) | A/B | INSULATION RESISTANCE (MΩ) | ANTI-FOULING PERFORMANCE |
|---|---|---|---|---|---|
| B01 | 61 | 30 | 2.0 | 50 | S |
| B02 | 57 | 28 | 2.0 | 50 | S |
| B03 | 57 | 27 | 2.1 | 30 | A |
| B04 | 60 | 29 | 2.1 | 30 | A |
| B05 | 65 | 30 | 2.2 | 30 | A |
| B06 | 61 | 28 | 2.2 | 30 | A |
| B07 | 61 | 27 | 2.3 | 20 | B |
| B08 | 63 | 27 | 2.3 | 20 | B |
| B09 | 65 | 27 | 2.4 | 20 | B |
| B10 | 68 | 28 | 2.4 | 20 | B |
| B11 | 70 | 28 | 2.5 | 5 | C |
| B12 | 68 | 27 | 2.5 | 5 | C |
| B13 | 70 | 27 | 2.6 | 5 | C |
| B14 | 75 | 29 | 2.6 | 5 | C |

FIG. 9

| SAMPLE NO. | R OF FIRST CONNECTION PART (mm) | R OF SECOND CONNECTION PART (mm) | PRESENCE OF THIRD CONNECTION PART | R OF THIRD CONNECTION PART (mm) | FLASHOVER OCCURRENCE RATE |
|---|---|---|---|---|---|
| C01 | – | – | NO | – | B |
| C02 | 0.1 | – | NO | – | B |
| C03 | – | 0.1 | NO | – | B |
| C04 | 0.1 | 0.1 | NO | – | A |
| C05 | – | – | YES | – | A |
| C06 | – | – | YES | 0.1 | S |
| C07 | – | – | YES | 0.6 | S |
| C08 | – | – | YES | 1.0 | S |
| C09 | – | – | YES | 1.4 | S |
| C10 | – | – | YES | 1.8 | S |
| C11 | 0.1 | – | YES | 1.0 | S |
| C12 | – | 0.1 | YES | 1.0 | S |
| C13 | 0.1 | 0.1 | YES | 1.0 | S |

FIG. 10

| SAMPLE NO. | A ($mm^3$) | B ($mm^3$) | A/B | INSULATOR STRENGTH |
|---|---|---|---|---|
| D01 | 58 | 31 | 1.9 | S |
| D02 | 56 | 29 | 1.9 | S |
| D03 | 54 | 27 | 2.0 | S |
| D04 | 52 | 25 | 2.1 | S |
| D05 | 50 | 23 | 2.2 | A |

SPARK PLUG

This application claims priority from Japanese Patent Application No. 2013-265208 filed with the Japan Patent Office on Dec. 24, 2013, the entire content of which is hereby incorporated by reference.

BACKGROUND OF THE INVENTION

1. Technical Field

The present disclosure relates to a sparkplug.

2. Description of the Related Art

In recent years, there has been an increased demand for the anti pre-ignition performance and the anti-fouling performance of a sparkplug due to a higher compression and a higher output of the engine.

The anti pre-ignition performance refers to a performance for suppressing excessive heating of the front end of the sparkplug to suppress the occurrence of the pre-ignition. The pre-ignition refers to a phenomenon in which an excessively heated front end of an insulator of the sparkplug serves as a heat source and thereby combustion starts spontaneously inside a combustion chamber of the engine before the ignition of the sparkplug.

The anti-fouling performance refers to a performance for suppressing the occurrence of a spark at a portion where carbon has been attached. Once a large amount of the carbon is attached near the front end of the insulator of the sparkplug, a current flows in the carbon. As a result, this may cause a leakage (a short circuit) phenomenon in which, instead of running between electrodes of the sparkplug, a spark runs at the portion where the carbon has been attached. The carbon that has attached to the front end of the insulator has the characteristics to burn out at around 520 degrees centigrade or higher. Thus, there has been proposed a sparkplug having a self-cleaning function that causes the carbon to burn out by its own heat by rapidly increasing the temperature up to around 520 degrees centigrade.

As described above, the anti pre-ignition performance is improved as the rise in the temperature of the insulator of the sparkplug is suppressed, while the anti-fouling performance is improved as the temperature of the insulator of the sparkplug rises. Therefore, it has been a problem that it is difficult to achieve both anti pre-ignition performance and anti-fouling performance of the sparkplug.

Conventionally, a technique disclosed in, for example, Japanese Patent Application Laid-open No. 2005-183177 has been known as the technique for achieving both anti pre-ignition performance and anti-fouling performance of the sparkplug. Also see Japanese Patent Application Laid-open No. 2002-260817.

SUMMARY OF THE INVENTION

A sparkplug according to the present disclosure includes: an insulator having an axial hole extending along an axial line; a center electrode inserted in the axial hole; a metal shell disposed in an outer circumference of the insulator; and a ground electrode disposed in a front end of the metal shell. A shelf part protruding inward in a radial direction is formed on an inner circumference of the metal shell. The insulator includes: a first column part formed in a position facing at least a part of the shelf part; a taper part formed in a front end side of the first column part and having a diameter decreasing toward the front end side; and a second column part formed in the front end side of the taper part. When a volume of the insulator surrounded by a first plane that passes through the front end of the shelf part of the metal shell and is orthogonal to the axial line, a curved surface extending from an outer circumference of the second column part, and an outer circumference surface of the insulator is defined as A, and a volume of the insulator surrounded by the first plane, the curved surface, a second plane that passes through the front end of the metal shell and is orthogonal to the axial line, and the axial hole of the insulator is defined as B, a relational expression $0.9 \leq A/B \leq 2.4$ is satisfied.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 7 is an illustration view indicating a result of an anti pre-ignition performance evaluation test in a form of a table;

FIG. 8 is an illustration view indicating a result of an anti-fouling performance evaluation test in a form of a table;

FIG. 9 is an illustration view indicating an experiment result regarding flashover in a form of a table; and FIG. 10 is an illustration view indicating a result of an insulator strength test in a form of a table.

DETAILED DESCRIPTION OF THE INVENTION

Figure 1:
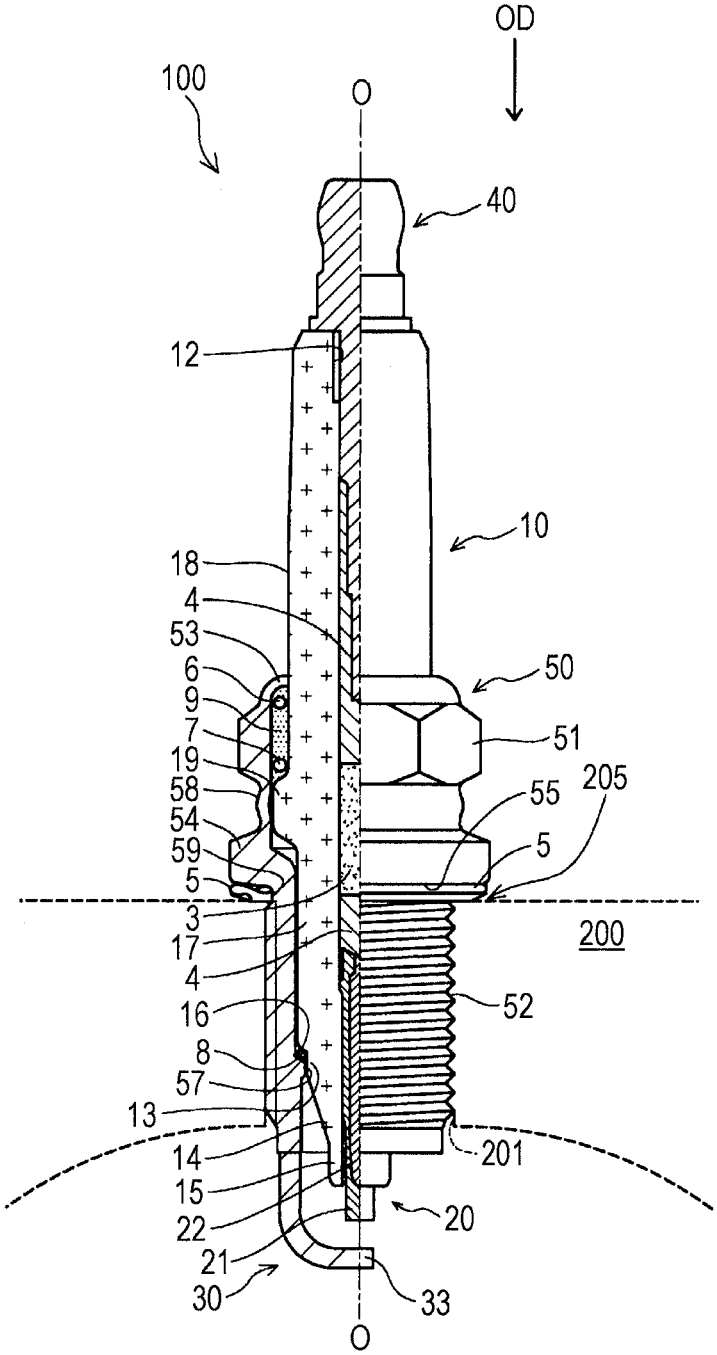
FIG. 1 is a partial sectional view illustrating a sparkplug as one embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, there has been a demand for further improvement of the anti pre-ignition performance and the anti-fouling performance of the sparkplug. Besides, in the conventional sparkplug, there have been desires for reduction in size, reduction in cost, resource saving, easier manufacturing, improvement of usability, and so on.

The present disclosure has been made for solving at least one of the above-described problems. The solution to the problems can be achieved by the following embodiments.

(1) According to a form of the present disclosure, a sparkplug is provided. The sparkplug includes: an insulator having an axial hole extending along an axial line; a center electrode inserted in the axial hole; a metal shell disposed in an outer circumference of the insulator; and a ground electrode disposed in a front end of the metal shell. A shelf part protruding inward in a radial direction is formed on an inner circumference of the metal shell. The insulator includes: a first column part formed in a position facing at least a part of the shelf part; a taper part formed in a front end side of the first column part and having a diameter decreasing toward the front end side; and a second column part formed in the front end side of the taper part. When a volume of the insulator surrounded by a first plane that passes through the front end of the shelf part of the metal shell and is orthogonal to the axial line, a curved surface extending from an outer circumference of the second column part, and an outer circumference surface of the insulator is defined as A, and a volume of the insulator surrounded by the first plane, the curved surface, a second plane that passes through the front end of the metal shell and is orthogonal to the axial line, and the axial hole of the insulator is defined as B, a relational expression $0.9 \leq A/B \leq 2.4$ is satisfied.

It has been confirmed by an experiment that a larger value of the volume ratio A/B in the insulator allows for the improvement of the anti pre-ignition performance of the sparkplug. On the other hand, it has been confirmed by an experiment that a smaller value of the volume ratio A/B allows for the improvement of the anti-fouling performance of the sparkplug. In the sparkplug of the above form, the volume ratio A/B is defined within the range of the above-described relational expression, so that both anti pre-ignition performance and the anti-fouling performance can be achieved.

(2) In the sparkplug according to the above-described form, at least one of a connection portion between the first column part and the taper part and a connection portion between the taper part and the second column part may be shaped in a curve.

In the sparkplug of this form, the electric field intensity in at least one of the connection portion between the first column part and the taper part and the connection portion between the taper part and the second column part is reduced, so that the occurrence of the spark between the inner circumference surface of the metal shell and the outer circumference surface of the insulator (hereafter, also referred to as "flashover") can be suppressed.

(3) In the sparkplug according to the above-described form, the taper part may include a first taper part and a second taper part formed in the front end side of the first taper part, and in a cross section by a plane including the axial line, an angle formed by a surface of the first taper part and a surface of the second taper part and facing the metal shell may be less than 180 degrees.

In the sparkplug of this form, the distance between the metal shell and the taper part is increased, so that the occurrence of the flashover can be further suppressed.

(4) In the sparkplug of the above-described form, the connection portion of the first taper part and the second taper part may be shaped in a curve.

According to the sparkplug of this form, the electric field intensity in the connection portion between the first taper part and the second taper part is reduced, so that the occurrence of the flashover can be further suppressed.

(5) In the sparkplug of the above-described form, the volume B may be larger than or equal to 25 $mm^3$.

According to the sparkplug of this form, the sufficient volume of the insulator is ensured, so that the strength of the insulator can be improved.

(6) In the sparkplug of the above-described form, a thread part is formed in the metal shell, and the thread diameter of the thread part may be 14 mm.

According to the sparkplug of this form, both anti pre-ignition performance and the anti-fouling performance of the sparkplug whose thread diameter is 14 mm can be achieved.

The present disclosure can be implemented in various forms other than the sparkplug. For example, the present disclosure can be implemented in a form of a manufacturing method of the sparkplug.

Next, the forms of implementation of the present disclosure will be described in the following order based on the embodiments.

A to D. First to fourth embodiments:

E. Experiment examples:

E-1. Experiment example regarding anti pre-ignition performance:

E-2. Experiment example regarding anti-fouling performance:

E-3. Experiment example regarding flashover:

E-4. Experiment example regarding strength of the insulator:

F. Modified examples:

A. First Embodiment

FIG. 1 is a partial sectional view illustrating a sparkplug 100 as one embodiment of the present disclosure.

In the following description, a direction (an axial line direction) OD that is parallel to an axial line illustrated in FIG. 1 is defined as the vertical direction in the figure, and the lower side is defined as the front end side of the sparkplug and the upper side is defined as the rear end side of the same. It is noted that, in FIG. 1, the external view of the sparkplug 100 is depicted in the right side of the axial line O. Further, the sectional view of the sparkplug 100 is depicted in the left side of the axial line O.

The sparkplug 100 is a device that is mounted in an engine head 200 of an internal combustion engine. The air-fuel mixture (combustion gas+air) inside a combustion chamber of the internal combustion engine is ignited by causing a spark discharge to occur between electrodes in the front end.

The sparkplug 100 has an insulator 10, a center electrode 20, a ground electrode 30, a terminal metal fitting 40, and a metal shell 50. The insulator 10 is a member that functions as an insulator. The insulator 10 has an axial hole 12 extending along the axial line O. The center electrode 20 is a bar-shaped electrode extending along the axial line O. The center electrode 20 is held inserted in the axial hole 12 of the insulator 10.

The metal shell 50 is a cylindrical member surrounding the outer circumference surface of the insulator 10. The metal shell 50 fixes the insulator 10 in the inside thereof.

One end of the ground electrode 30 is fixed to the front end of the metal shell 50 and the other end faces the center electrode 20. The terminal metal fitting 40 is a terminal for being supplied with electric power. The terminal metal fitting 40 is electrically connected to the center electrode 20. The sparkplug 100 is mounted in the engine head 200. Under this state, in response that a high voltage is applied between the terminal metal fitting 40 and the engine head 200, a spark discharge occurs between the center electrode 20 and the ground electrode 30. The details of respective members will be described below.

The insulator 10 is a cylindrical insulator formed of ceramics. The axial hole 12 extending in the axial line direction OD of the insulator 10 is formed along the axial line O. In the present embodiment, the insulator 10 is formed by sintering alumina. A flange part 19 is formed in substantially the center of the axial line direction OD of the insulator 10. The outer diameter of the insulator 10 is largest at the flange part 19. In the rear end side of the flange part 19, a rear-end-side trunk part 18 is formed. In the front end side of the flange part 19, a front-end-side trunk part 17 whose outer diameter is smaller than that of the rear-end-side trunk part 18 is formed. In further front end side of the front-end-side trunk part 17, a first column part 13, a taper part 14, and a second column part 15 are formed. The outer diameter of the taper part 14 decreases as it is close to the front end side. Under the state that the sparkplug 100 is mounted in the engine head 200 of the internal combustion engine, the taper part 14 and the second column part 15 are exposed inside the combustion chamber of the internal combustion engine. An outer circumference step part 16 is formed between the first column part 13 and the front-end-side trunk part 17.

The center electrode 20 is disposed inside the axial hole 12 of the insulator 10. The center electrode 20 is a bar-shaped member extending from the rear end side toward the front end side. The front end of the center electrode 20 is exposed from the insulator 10 in the front end side. In the structure of the center electrode 20 of the present embodiment, a core material 22 is buried inside an electrode base material 21. The electrode base material 21 is formed of a nickel alloy such as the Inconel™ 600 and the like. The core material 22 is formed of copper or an alloy whose main component is copper that has a higher thermal conductivity than that of the electrode base material 21.

Inside the axial hole 12 of the insulator 10, a seal member 4 and a ceramic resistor 3 are provided in the rear end side of the center electrode 20. The center electrode 20 is electrically connected to the terminal metal fitting 40 via the seal member 4 and the ceramic resistor 3.

The metal shell 50 is a cylindrical metal shell formed of a low-carbon steel material. The metal shell 50 holds the insulator 10 in the inside thereof. A portion from a part of the rear-end-side trunk part 18 of the insulator 10 to a part of the second column part 15 is surrounded by the metal shell 50.

On the outer circumference of the metal shell 50, a tool engagement part 51 and a thread part 52 are formed. A sparkplug wrench (not shown) is fitted to the tool engagement part 51. Thread ridges are formed on the thread part 52 of the metal shell 50. The thread part 52 of the metal shell 50 is screwed with a mounting thread hole 201 of the engine head 200 of the internal combustion engine. The sparkplug 100 is fixed to the engine head 200 of the internal combustion engine by screwing the thread part 52 of the metal shell 50 into the mounting thread hole 201 of the engine head 200 and tightening the thread part 52 against the mounting thread hole 201. It is noted that the thread diameter of the thread part 52 of the present embodiment is 14 mm.

A flange-shaped flange part 54 protruding outward in the radial direction is formed between the tool engagement part 51 and the thread part 52 of the metal shell 50. An annular gasket 5 is inserted and fitted in a thread root 59 between the thread part 52 and the flange part 54. The gasket 5 is formed by bending a sheet member. When the sparkplug 100 is mounted in the engine head 200, the gasket 5 is deformed by being pressed between a seating portion 55 of the flange part 54 and an opening circumference edge 205 of the mounting thread hole 201. The clearance between the sparkplug 100 and the engine head 200 is sealed by this deformation of the gasket 5. As a result, the leakage of the combustion gas via the mounting thread hole 201 is suppressed.

In the rear end side of the tool engagement part 51 of the metal shell 50, a thin crimping part 53 is formed. Further, a thin buckling part 58 is formed between the flange part 54 and the tool engagement part 51. Annular ring members 6 and 7 are inserted between the inner circumference surface of the metal shell 50 from the tool engagement part 51 to the crimping part 53 and the outer circumference surface of the rear-end-side trunk part 18 of the insulator 10. Furthermore, powder of talc 9 is filled between the ring members 6 and 7. In the manufacturing process of the sparkplug 100, once the crimping part 53 is bent inward and crimped, the buckling part 58 is deformed (buckled) outward in response to the application of the compressing force, and the metal shell 50 and the insulator 10 are fixed to each other. The talc 9 is compressed in this crimping process and thus the sealing property between the metal shell 50 and the insulator 10 is enhanced.

On the inner circumference of the metal shell 50, a shelf part 57, which can be also described as an annular projection, protruding inward in the radial direction is formed. An annular plate packing 8 is provided between the shelf part 57 (annular projection) of the metal shell 50 and the outer circumference step part 16 of the insulator 10. The sealing property between the metal shell 50 and the insulator 10 is ensured also by this plate packing 8. The leakage of the combustion gas is therefore suppressed by the plate packing 8.

The ground electrode 30 is an electrode jointed to the front end of the metal shell 50. The ground electrode 30 is preferably formed of an alloy that is superior in corrosion resistance. In the present embodiment, the ground electrode 30 is formed of nickel or an alloy whose main component is nickel such as the Inconel™ 600, the Inconel™ 601, or the like. The jointing of the ground electrode 30 and the metal shell 50 is made by a welding, for example. A front end part 33 of the ground electrode 30 faces the front end of the center electrode 20.

A high voltage cable (not shown) is connected to the terminal metal fitting 40 via a plug cap (not shown). As described above, the application of the high voltage between the terminal metal fitting 40 and the engine head 200 causes the spark discharge to occur between the ground electrode 30 and the center electrode 20.

Figure 2:
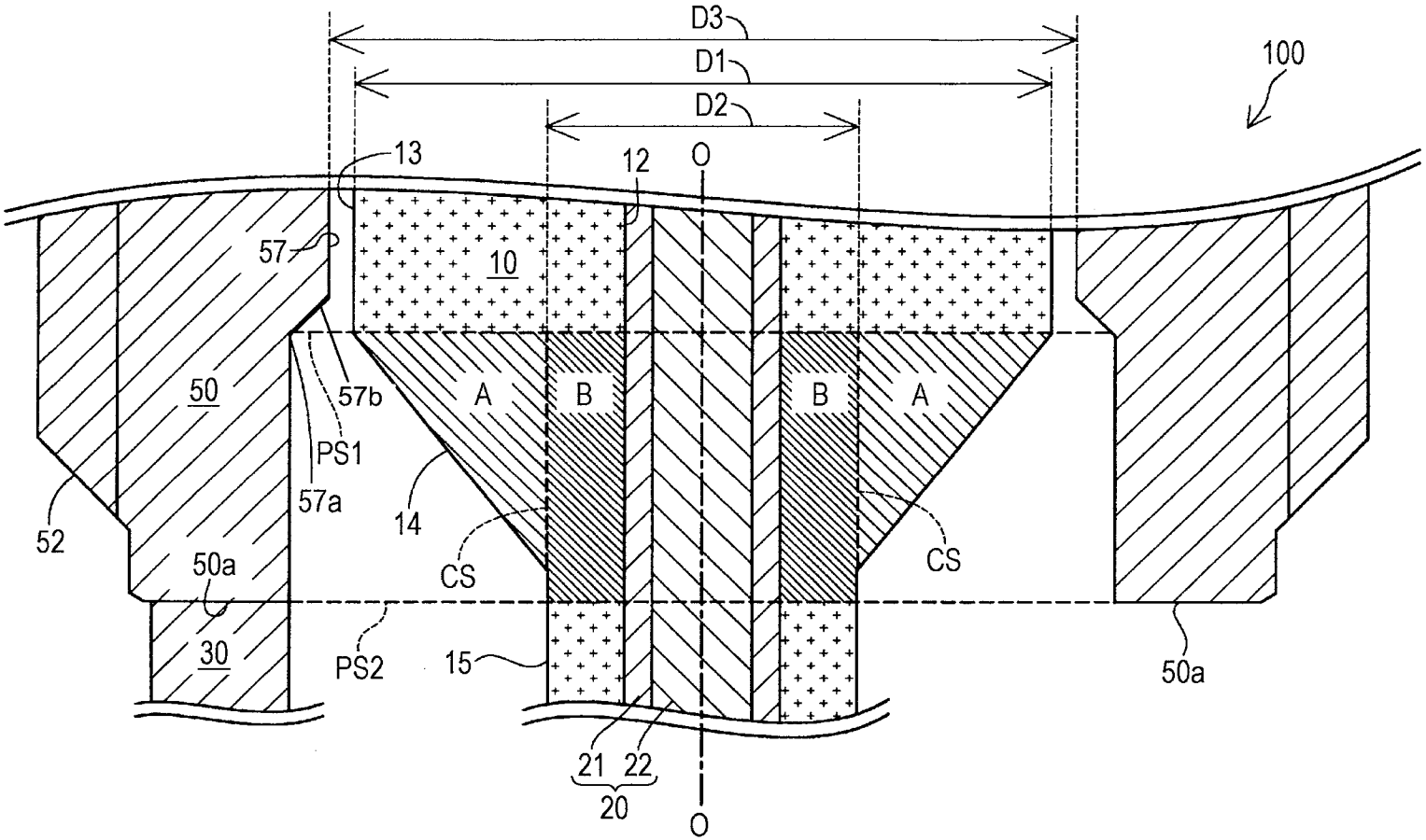
FIG. 2 is a sectional view of an enlarged illustration around a front end of the sparkplug.

FIG. 2 is a sectional view of an enlarged illustration around the front end of the sparkplug 100. As illustrated in FIG. 2, the insulator 10 has the first column part 13, the taper part 14, and the second column part 15. The first column part 13 is formed at the position facing at least a part of the shelf part 57. The taper part 14 is formed in the front end side of the first column part 13 and has the diameter decreasing toward the front end side. The second column part 15 is formed in the front end side of the taper part 14. It is noted that the diameter D1 of the first column part 13 is larger than the diameter D2 of the second column part 15. The inner diameter D3 of the part at which the inner diameter of the shelf part 57 is smallest is larger than the diameter D1 of the first column part 13.

In the present embodiment, a volume of the insulator 10 surrounded by a first plane PS1 that passes through a front end 57*a* of the shelf part 57 of the metal shell 50 and is orthogonal to the axial line O, a curved surface CS extending from the outer circumference of the second column part 15, and the outer circumference surface of the insulator 10 is defined as A. A volume of the insulator 10 surrounded by the first plane PS1, the curved surface CS, a second plane PS2 that passes through a front end 50*a* of the metal shell 50 and is orthogonal to the axial line O, and the axial hole 12 of the insulator 10 is defined as B. The shelf part 57 has a taper portion 57*b* where the internal diameter of the metal shell 50 increases from a minimum internal diameter in the direction toward the front end of the metal shell 50 until the taper portion 57*b* reaches the front end thereof, which is also the front end 57*a* of the shelf part 57. In this case, the sparkplug 100 of the present embodiment satisfies the following relational expression (1).

$$0.9 \leq A/B \leq 2.4 \quad (1)$$

The basis for defining as such will be described. After many experiments, the inventors have found the relationship between the volume ratio A/B in the insulator 10 and the anti pre-ignition performance and anti-fouling performance of the sparkplug 100. After further study, the inventors have found that a larger value of the volume ratio A/B in the insulator 10 allows for the improvement of the anti pre-ignition performance of the sparkplug 100. Also, the inventors have found that a smaller value of the volume ratio A/B allows for the improvement of the anti-fouling performance of the sparkplug 100. Further, the inventors have found that, when the value of the volume ratio A/B is within the range indicated by the above-described relational expression (1), both the anti pre-ignition performance and anti-fouling performance of the sparkplug 100 are achieved.

It is noted that the reason why a larger value of the volume ratio A/B in the insulator 10 allows for the improvement of the anti pre-ignition performance of the sparkplug 100 is considered as follows. That is, an increase in the volume A with respect to the volume B results in the reduction in the distance between the outer circumference of the insulator 10 and the inner circumference of the metal shell 50. As a result, the heat of the insulator 10 is likely to be transferred to the metal shell, so that the anti pre-ignition performance is improved.

On the other hand, the reason why a smaller value of the volume ratio A/B allows for the improvement of the anti-fouling performance of the sparkplug 100 is considered as follows. That is, a reduction in the volume A with respect to the volume B results in that the insulator 10 becomes thinner and its temperature is likely to be high. As a result, the carbon is likely to burn out, so that the anti-fouling performance is improved Furthermore, in the present embodiment, the above-described volume B is greater than or equal to 25 $mm^3$. According to the sparkplug 100 of the present embodiment, the sufficient volume of the insulator 10 is ensured, so that the strength of the insulator 10 can be improved. In particular, the bending strength of the insulator 10 tends to depend on the volume B of the insulator lying around the axial hole 12. Therefore, the present embodiment allows for the improvement of the bending strength of the insulator 10.

In this way, the sparkplug 100 of the present embodiment satisfies the above-described relational expression (1), so that both anti pre-ignition performance and anti-fouling performance can be achieved.

B. Second Embodiment

Figure 3:
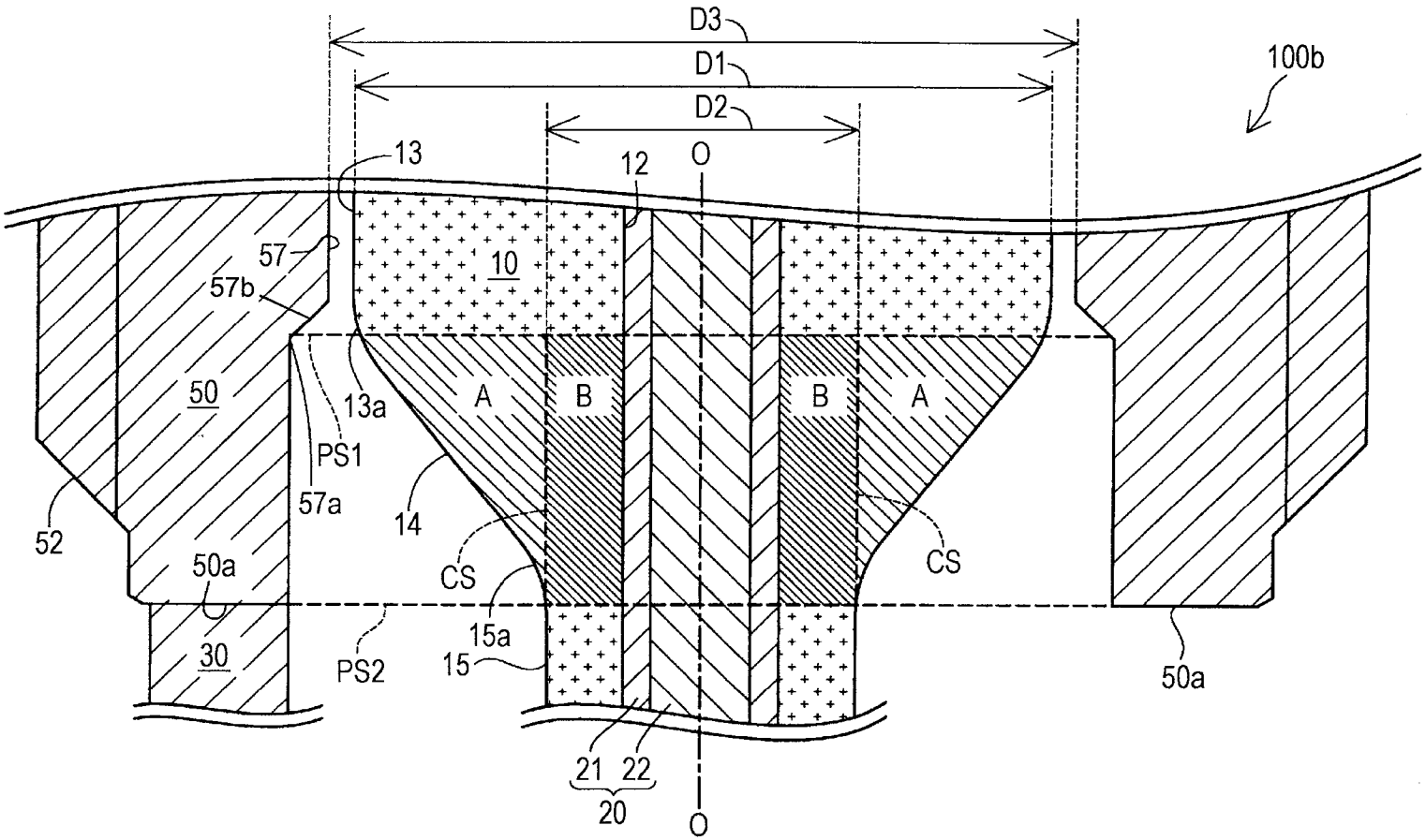
FIG. 3 is a sectional view of an enlarged illustration around a front end of a sparkplug as a second embodiment.

FIG. 3 is a sectional view of an enlarged illustration around the front end of a sparkplug 100*b* as a second embodiment. The difference from the first embodiment illustrated in FIG. 2 is in that a connection portion 13*a* between the first column part 13 and the taper part 14 and a connection portion 15*a* between the taper part 14 and the second column part 15 are each shaped in a curve. Other configurations are the same as those in the first embodiment. It is noted that, in the followings, the connection portion 13*a* between the first column part 13 and the taper part 14 is also referred to as "first connection part 13*a*". Further, the connection portion 15*a* between the taper part 14 and the second column part 15 is also referred to as "second connection part 15*a*". In the present embodiment, an R with the size of 0.1 mm is formed in the first connection part 13*a* and the second connection part 15*a*.

According to the sparkplug 100*b* of the present embodiment, the electric field intensity at the first connection part 13*a* and the second connection part 15*a* is reduced. Therefore, this allows for the suppression of the occurrence of the spark between the inner circumference surface of the metal shell 50 and the outer circumference surface of the insulator 10 (hereafter, also referred to as "flashover").

C. Third Embodiment

Figure 4:
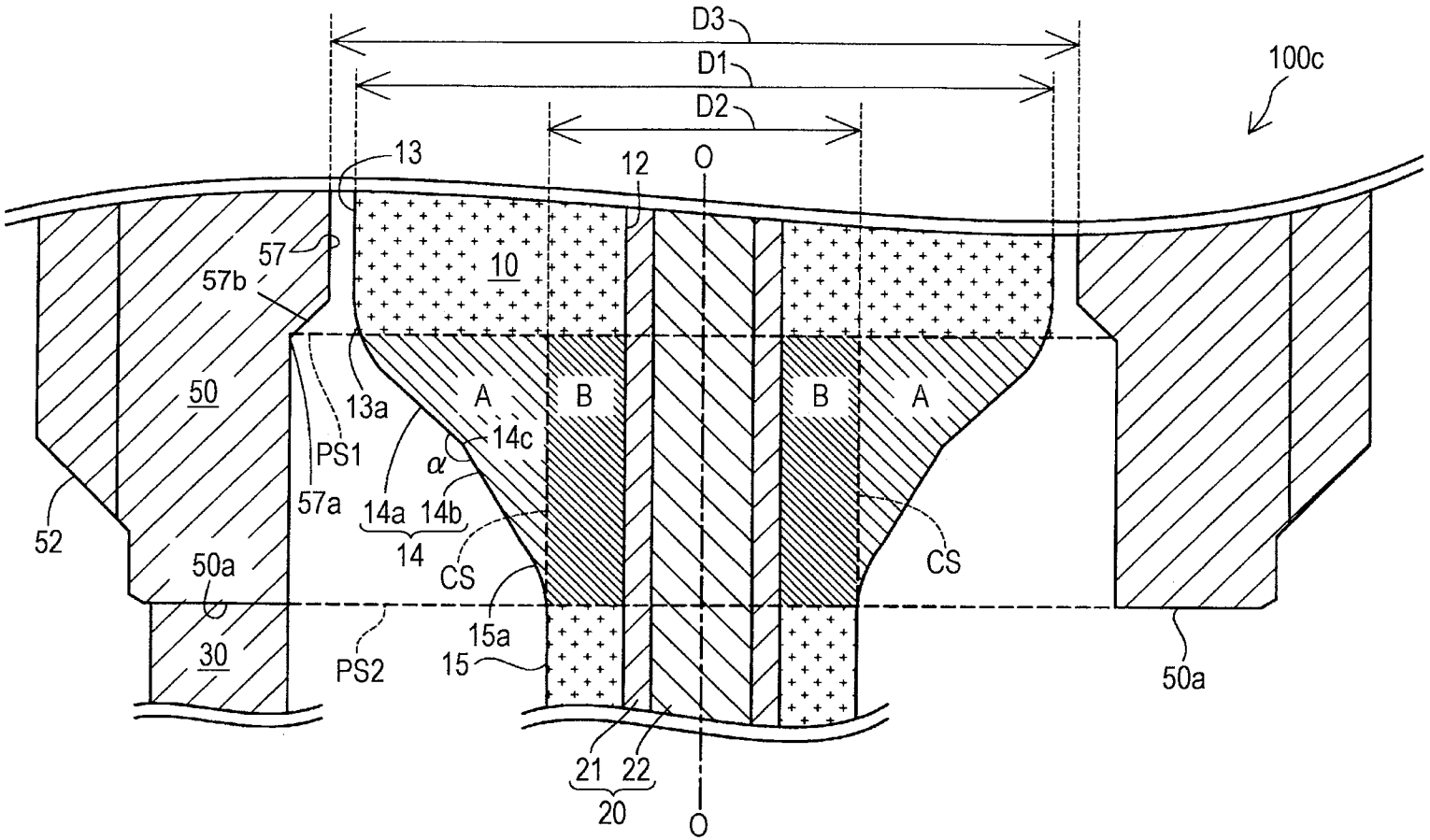
FIG. 4 is a sectional view of an enlarged illustration around a front end of a sparkplug as a third embodiment.

FIG. 4 is a sectional view of an enlarged illustration around the front end of a sparkplug 100*c* as a third embodiment. The difference from the second embodiment illustrated in FIG. 3 is in that the taper part 14 has a first taper part 14*a* and a second taper part 14*b* formed in the front end side of the first taper part 14*a*. Other configurations are the same as those in the second embodiment. It is noted that, in the followings, a connection portion 14*c* between the first taper part 14*a* and the second taper part 14*b* is also referred to as "third connection part 14*c*".

As illustrated in FIG. 4, in the present embodiment, the angle α that is formed by the surface of the first taper part 14*a* and the surface of the second taper part 14*b* and faces the metal shell 50 is less than 180 degrees in the cross section as the plane including the axial line O. According to the sparkplug 100*c* of the present embodiment, the distance between the inner circumference of the metal shell 50 and the outer circumference of the taper part 14 is increased compared to the case where the first column part 13 and the second column part 15 are disposed by the taper part 14 having a single even inclination. Therefore, the occurrence of the flashover can be further suppressed.

D. Fourth Embodiment

Figure 5:
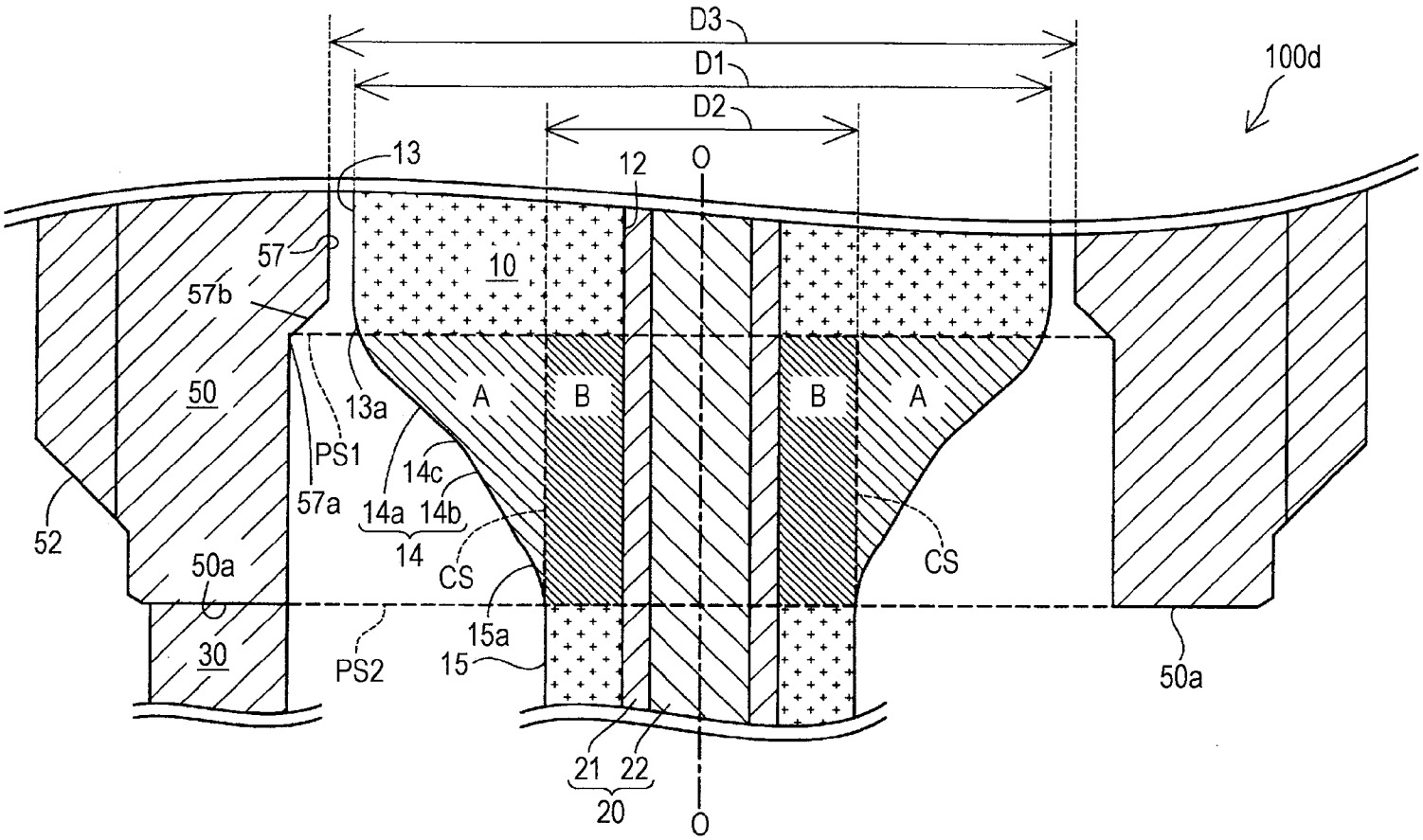
FIG. 5 is a sectional view of an enlarged illustration around a front end of a sparkplug as a fourth embodiment.

FIG. 5 is a sectional view of an enlarged illustration around the front end of a sparkplug 100*d* as a fourth embodiment. The difference from the third embodiment illustrated in FIG. 4 is in that the third connection part 14*c* that is the connection portion between the first taper part 14*a* and the second taper part 14*b* is shaped in a curve. Other configurations are the same as those in the third embodiment. In the present embodiment, an R with the size of 1.0 mm is formed in the third connection part 14*c*.

According to the sparkplug 100*d* of the present embodiment, the electric field intensity at the third connection part 14*c* is reduced, so that the occurrence of the flashover can be further suppressed.

E. Experiment Examples

E-1. Experiment Example Regarding Anti Pre-Ignition Performance

In the present experiment, the relationship between the value of the volume ratio A/B and the anti pre-ignition performance was examined. A plurality of samples with the different volume ratio A/B was prepared. The anti pre-ignition performance of respective samples was evaluated by a test (an anti pre-ignition performance evaluation test).

As the anti pre-ignition performance evaluation test, a pre-ignition test based on the specification of JIS (Japanese Industrial Standard) D1606 was done. Specifically, each sample of the sparkplug was mounted in a four-cylinder DOHC (Double Over Head Camshaft) engine with the displacement of 1.3 L. Then, while the engine was operated at the full throttle state (=6000 rpm), the ignition timing was gradually advanced from the normal ignition timing. The ignition timing at which the pre-ignition occurred (an advanced timing for ignition) was determined by observing a waveform of the ion current applied to each sample. It is noted that a larger pre-ignition advance timing is less likely to cause the pre-ignition, that is, which means it is superior in the anti pre-ignition performance.

Figure 6:
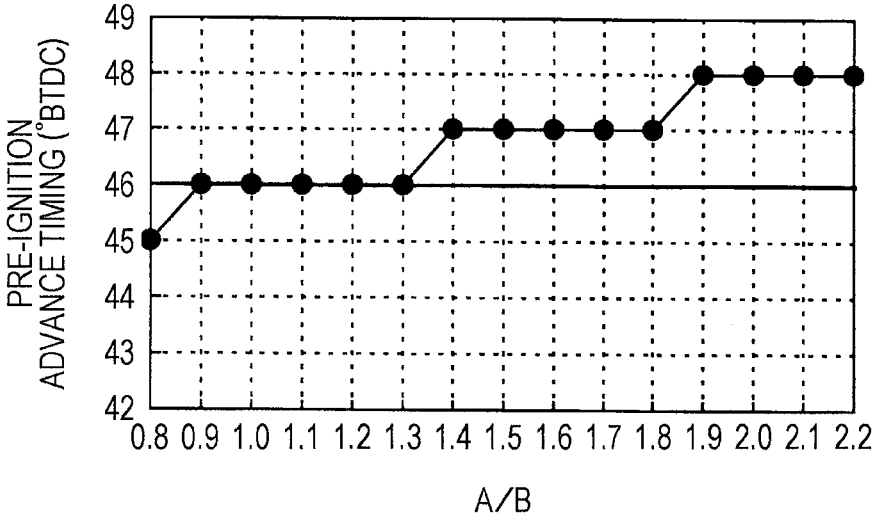
FIG. 6 is an illustration view indicating a result of an anti pre-ignition performance evaluation test in a form of a graph.

FIG. 6 is an illustration view indicating the result of the anti pre-ignition performance evaluation test in a form of a graph. FIG. 7 is an illustration view indicating the result of the anti pre-ignition performance evaluation test in a form of a table. In FIG. 7, the samples in which the pre-ignition advance timing was 48° BTDC (Before Top Dead Center) or greater were evaluated to be "S" as the highest evaluation. The samples in which the pre-ignition advance timing was 47° BTDC were evaluated to be "A" as the second highest evaluation. The samples in which the pre-ignition advance timing was 46° BTDC were evaluated to be "B" as the third highest evaluation. The samples in which the pre-ignition advance timing was 45° BTDC or less were evaluated to be "C" as a low evaluation. It is noted that the details of each sample are as follows.

The diameter D1 of the first column part 13: Φ6.9 to 7.6 mm

The diameter D2 of the second column part 15: Φ3.1 to 3.7 mm

According to FIG. 6 and FIG. 7, a larger value of the volume ratio A/B results in that the ignition timing at which the pre-ignition occurs is advanced. Therefore, it can be understood that a larger value of the volume ratio A/B allows for a superior anti pre-ignition performance. Specifically, when the volume ratio A/B is 0.9 or larger, the evaluation results in "B" or better. When the volume ratio A/B is 1.4 or larger, the evaluation results in "A" or better. When the volume ratio A/B is 1.9 or larger, the evaluation results in "S".

As set forth, it can be understood that, in terms of the improvement of the anti pre-ignition performance of the sparkplug 100, the volume ratio A/B is preferably 0.9 or larger, more preferably 1.4 or larger, and the most preferably 1.9 or larger.

E-2. Experiment Example Regarding Anti-Fouling Performance

In the present experiment example, the relationship between the value of the volume ratio A/B and the anti-fouling performance was examined. A plurality of samples with the different volume ratio A/B was prepared. The anti-fouling performance of respective samples was evaluated by a test (an anti-fouling performance evaluation test).

In the anti-fouling performance evaluation test, a pre-delivery fouling test based on the JIS D1606 was done in a test room at −10 degrees centigrade. Specifically, each sample of the sparkplug was mounted in a four-cylinder DOHC engine with the displacement of 1600 cc. Then, the engine was started, driven by the third gear at 35 km/h for 40 seconds after engine racing for a few times, idled for 90 seconds, again driven by the third gear at 35 km/h for 40 seconds, and then stopped. Then, complete cooling was done until the temperature of the cooling water reaches the room temperature, the engine was restarted and engine racing was done again, the operation for driving the engine by the first gear at 15 km/h for 15 seconds and subsequently stopping the engine for 30 seconds was made for two times, the engine was driven by the first gear at 15 km/h for 15 seconds again, and then the engine was stopped. A series of these test patterns are defined as one cycle, and ten cycles of the test were done for each one sample. After the ten cycles of the test were finished, the insulation resistance of the insulator 10 was measured.

FIG. 8 is an illustration view indicating the result of the anti-fouling performance evaluation test in a form of a table. In FIG. 8, the samples whose insulation resistance was higher than or equal to 50 MΩ were evaluated to be "S" as the highest evaluation. The samples whose insulation resistance was higher than or equal to 30 MΩ and lower than 50 MΩ were evaluated to be "A" as the second highest evaluation. The samples whose insulation resistance was higher than or equal to 20 MΩ and lower than 30 MΩ were evaluated to be "B" as the third highest evaluation. The samples whose insulation resistance was lower than 20 MΩ were evaluated to be "C" as a low evaluation. It is noted that the details of each sample are as follows.

The diameter D1 of the first column part 13: Φ6.9 to 7.6 mm

The diameter D2 of the second column part 15: Φ3.1 to 3.6 mm

According to FIG. 8, it can be understood that a smaller value of the volume ratio A/B allows for a superior anti-fouling performance. Specifically, when the volume ratio A/B is 2.4 or smaller, the evaluation is "B" or better. When the volume ratio A/B is 2.2 or smaller, the evaluation is "A" or better. When the volume ratio A/B is 2.0 or smaller, the evaluation is "S".

As set forth, it can be understood that, in terms of the improvement of the anti-fouling performance of the sparkplug 100, the volume ratio A/B is preferably 2.4 or smaller, more preferably 2.2 or smaller, and the most preferably 2.0 or smaller.

E-3. Experiment Example Regarding Flashover

In the present experiment, examined was the relationship between the presence or absence of the R in the first connection part 13*a* and the second connection part 15*a*, the presence or absence of the third connection part 14*c*, and the presence or absence of the R in the third connection part 14*c* and the occurrence rate of the flashover. A plurality of samples that is different in the presence or absence of the R in the first connection part 13*a* and the second connection part 15*a*, the presence or absence of the third connection part 14*c*, and the presence or absence of the R in the third connection part 14*c* were prepared. A flashover occurrence test was done for each sample. It is noted that the fact that the third connection part 14*c* is present means that the taper part 14 has the first taper part 14*a* and the second taper part 14*b* as indicated in the above-described third embodiment.

In the flashover occurrence test, the single-cylinder engine with the displacement of 0.2 L in which each sample of the sparkplug was mounted was driven for five minutes at a constant engine revolution of 2650 rpm. By this driving, carbon was attached to the insulator 10. Each sample was mounted in a visible chamber, and the spark was caused to generate at the sample for 100 times under a nitrogen atmosphere of 0.4 MPa. Whether or not the flashover occurred was examined by using a high voltage probe to observe the waveform.

FIG. 9 is an illustration view indicating the experiment result regarding the flashover in a form of a table. In FIG. 9, for 100 times of sparks, the samples in which the flashover occurred less than 10 times were evaluated to be "S" as the highest evaluation. The samples in which the flashover occurred more than or equal to 10 times and less than 50 times were evaluated to be "A" as the second highest evaluation. The samples in which the flashover occurred more than or equal to 50 times were evaluated to be "B" as a low evaluation. It is noted that the details of each sample are as follows.

Volume A: 59 $mm^3$

Volume B: 32 $mm^3$

The diameter D1 of the first column part 13: Φ7.4 mm

The diameter D2 of the second column part 15: Φ3.3 mm

The inner diameter D3 at which the inner diameter of the shelf part 57 is smallest: Φ7.9 mm In focusing on the sample C04, it can be understood that the evaluation results in "A" when the R of 0.1 mm is formed in the first connection part 13*a* and the second connection part 15*a*. In focusing on the sample C05 to sample C13, it can be understood that the evaluation results in "A" or better when the third connection part 14*c* is present regardless of the presence or absence of the R in the first connection part 13*a* and the second connection part 15*a*. In focusing on the sample C06 to sample C13, it can be understood that the evaluation results in "S" when the R of 0.1 mm or greater is formed in the third connection part 14*c*.

As set forth, the occurrence of the flashover can be suppressed by forming the R in the first connection part 13*a* and the second connection part 15*a*, the third connection part 14*c*, and the R in the third connection portion 14*c*.

E-4. Experiment Example Regarding Strength of the Insulator

In the present experiment example, the relationship between the volume B of the insulator 10 and the strength of the insulator 10 was examined. A plurality of samples with the different volume B was prepared, and an insulator strength test was done for each sample.

In the insulator strength test, while a weight was increasingly applied to the insulator 10, the weight at the time when the occurrence of the crack was first observed was measured. Specifically, a vertical weight was increasingly applied by a moment arm to the position within 1 mm from the front end of the insulator 10 by crimping each sample of the sparkplug to an iron test tool at a specified torque. It was examined by visual observation whether or not a crack occurred in the insulator 10. Then, the weight at which the crack occurred in the insulator 10 was measured. It is noted that, in this test, the speed of applying the weight is restricted to 1 mm/min or less so as not to cause an impact on the sparkplug.

FIG. 10 is an illustration view indicating the result of the insulator strength test in a form of a table. In FIG. 10, the samples in which the weight at which the crack occurred in the insulator 10 was greater than or equal to 200 N were evaluated to be "S" as the highest evaluation. The sample in which the weight at which the crack occurred in the insulator 10 was less than 200 N was evaluated to be "A". It is noted that the details of each sample are as follows.

The shape of the insulator 10: the fourth embodiment

The diameter D1 of the first column part 13: Φ7.4 mm

The diameter D2 of the second column part 15: Φ3.3 to 3.7 mm

The inner diameter D3 at which the inner diameter of the shelf part 57 is smallest: Φ7.9 mm According to FIG. 10, it can be understood that a larger volume B results in the increased strength of the insulator 10. Specifically, it can be understood that the volume B that is greater than or equal to 25 $mm^3$ allows for the evaluation "S". As set forth, in terms of the improvement of the strength of the insulator 10, the volume B is preferably larger than or equal to 25 $mm^3$.

It is noted that, in focusing the volume A, it can also be understood that a larger volume A results in the increased strength of the insulator 10. Specifically, it can also be understood that the volume A that is larger than or equal to 52 $mm^3$ allows for the evaluation "S". Therefore, the volume A is preferably larger than or equal to 52 $mm^3$.

F. Modified Examples

It is noted that the form of the sparkplug of the present disclosure is not limited to the above-described embodiments. It can be implemented in various forms other than the embodiments of the present disclosure within the scope not departing from its spirit. For example, the following modifications are possible.

Modified Example 1

In the above-described second to fourth embodiments, any one of the first connection part 13*a* and the second connection part 15*a* may not be shaped in a curve.

Modified Example 2

In the above-described first embodiment, the taper part 14 may have the first taper part 14*a* and the second taper part 14*b* as seen in the third embodiment, or the third connection part 14*c* that is the connection portion between the first taper part 14*a* and the second taper part 14*b* may be shaped in a curve as seen in the fourth embodiment.

The sparkplug of the present disclosure is not limited to the above-described embodiments, examples, and modified examples. It can be implemented in various configurations within the scope not departing from its spirits. For example, the technical features in the embodiments, the examples, and the modified examples corresponding to those in respective forms described in the part of the DESCRIPTION OF THE EMBODIMENTS can be properly interchanged or combined in order to solve a part of or all of the above-described problems or achieve a part of or all of the above-described advantages. Further, unless such a technical feature is described as the essential feature in the present specification, it can be properly deleted.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A sparkplug comprising:

an insulator having an axial hole extending along an axial line;

a center electrode inserted in the axial hole;

a metal shell disposed in an outer circumference of the insulator; and a ground electrode disposed at a front end of the metal shell, wherein the metal shell has a shelf part that protrudes inward in a radial direction and is formed on an inner circumference thereof, the insulator includes: a first column part facing at least a part of the shelf part; a taper part formed at a front end side of the first column part and having a decreasing diameter; and a second column part formed at the front end side of the taper part, said taper part diameter decreasing toward said second column, and when a volume of the insulator surrounded by a first plane that passes through the front end of the shelf part of the metal shell and is orthogonal to the axial line, a curved surface extending from an outer circumference of the second column part, and an outer circumference surface of the insulator is defined as A, and a volume of the insulator surrounded by the first plane, the curved surface, a second plane that passes through the front end of the metal shell and is orthogonal to the axial line, and the axial hole of the insulator is defined as B, a relational expression $$0.9 \leq A/B \leq 2.4$$

is satisfied.

2. The sparkplug according to claim 1, wherein at least one of a connection portion between the first column part and the taper part and a connection portion between the taper part and the second column part has a curved shape.

3. The sparkplug according to claim 1, wherein the taper part includes a first taper part and a second taper part formed in the front end side of the first taper part, and wherein, in a cross section by a plane including the axial line, an angle formed by a surface of the first taper part and a surface of the second taper part and facing the metal shell is less than 180 degrees.

4. The sparkplug according to claim 3, wherein a connection portion between the first taper part and the second taper part has a curved shape.

5. The sparkplug according to claim 1, wherein the volume B is larger than or equal to 25 $mm^3$.

6. The sparkplug according to claim 1, wherein a thread part is formed on the metal shell, said thread part having a thread diameter of 14 mm.

7. The sparkplug according to claim 2, wherein the taper part includes a first taper part and a second taper part formed in the front end side of the first taper part, and wherein, in a cross section by a plane including the axial line, an angle formed by a surface of the first taper part and a surface of the second taper part and facing the metal shell is less than 180 degrees.

8. The sparkplug according to claim 2, wherein the volume B is larger than or equal to 25 $mm^3$.

9. The sparkplug according to claim 3, wherein the volume B is larger than or equal to 25 $mm^3$.

10. The sparkplug according to claim 4, wherein the volume B is larger than or equal to 25 $mm^3$.

11. The sparkplug according to claim 2, wherein a thread part is formed on the metal shell, said thread part having a thread diameter of 14 mm.

12. The sparkplug according to claim 3, wherein a thread part is formed on the metal shell, said thread part having a thread diameter of 14 mm.

13. The sparkplug according to claim 4, wherein a thread part is formed on the metal shell, said thread part having a thread diameter of 14 mm.

14. The sparkplug according to claim 5, wherein a thread part is formed on the metal shell, said thread part having a thread diameter of 14 mm.

* * * * *